US008026785B2

(12) United States Patent
Tetik

(10) Patent No.: US 8,026,785 B2
(45) Date of Patent: Sep. 27, 2011

(54) SWITCHING DEVICE

(75) Inventor: Adolf Tetik, Vienna (AT)

(73) Assignee: Moeller Gebäudeautomation GmbH, Schrems (AT)

( * ) Notice: Subject to any disclaimer, the term of this patent is extended or adjusted under 35 U.S.C. 154(b) by 85 days.

(21) Appl. No.: 12/397,866

(22) Filed: Mar. 4, 2009

(65) Prior Publication Data

US 2009/0224864 A1 Sep. 10, 2009

Related U.S. Application Data

(60) Provisional application No. 61/033,913, filed on Mar. 5, 2008.

(30) Foreign Application Priority Data

Mar. 5, 2008 (AT) ..... 357/2008

(51) Int. Cl.
*H01H 37/52* (2006.01)

(52) U.S. Cl. ..... 337/85; 337/36; 337/111; 337/372

(58) Field of Classification Search ..... 337/372, 337/36, 85, 111
See application file for complete search history.

(56) References Cited

U.S. PATENT DOCUMENTS

| | | | | | |
|---|---|---|---|---|---|
| 2,304,018 | A | * | 12/1942 | Raney | 337/57 |
| 2,701,284 | A | * | 2/1955 | Edmunds | 337/71 |
| 2,811,610 | A | * | 10/1957 | Bletz | 337/377 |
| 3,434,089 | A | * | 3/1969 | Butting et al. | 337/40 |
| 3,546,651 | A | * | 12/1970 | Moorhead et al. | 337/102 |
| 3,944,870 | A | * | 3/1976 | Sutton et al. | 315/8 |
| 4,458,231 | A | * | 7/1984 | Senor | 337/107 |
| 4,476,452 | A | * | 10/1984 | D'Entremont | 337/102 |
| 4,486,732 | A | | 12/1984 | Wells et al. | |
| 4,719,438 | A | * | 1/1988 | Mrenna et al. | 335/38 |
| 4,951,015 | A | * | 8/1990 | Shea et al. | 335/38 |
| 5,206,622 | A | * | 4/1993 | Lattari | 337/89 |
| 5,808,539 | A | * | 9/1998 | White | 337/379 |
| 5,831,509 | A | * | 11/1998 | Elms et al. | 337/333 |
| 5,894,259 | A | * | 4/1999 | Kolberg et al. | 337/333 |
| 6,135,633 | A | * | 10/2000 | DiMarco et al. | 374/1 |
| 6,181,226 | B1 | * | 1/2001 | Leone et al. | 335/35 |
| 6,483,418 | B1 | * | 11/2002 | Reno et al. | 337/379 |
| 6,515,569 | B2 | * | 2/2003 | Lias et al. | 337/37 |
| 6,525,640 | B1 | * | 2/2003 | Busnello | 337/85 |
| 7,518,482 | B2 | * | 4/2009 | Fleege | 337/59 |
| 7,800,477 | B1 | * | 9/2010 | Komer | 337/102 |

FOREIGN PATENT DOCUMENTS

| | | |
|---|---|---|
| DE | 24 48 026 | 4/1976 |
| DE | 26 10 951 | 1/1980 |
| DE | 33 38 799 A1 | 5/1985 |
| DE | 10 2006 005 697 | 8/2007 |

* cited by examiner

*Primary Examiner* — Anatoly Vortman
(74) *Attorney, Agent, or Firm* — Henry M. Feiereisen; Ursula B. Day

(57) ABSTRACT

A switching device has an input terminal and an output terminal for connection to electrical conductors, and two switching contacts which, when closed, close a current path between the input terminal and the output terminal. An overcurrent trigger device which includes a bimetallic element heated by an electric current flow is provided for disconnecting the two switching contacts. A thermal insulator is arranged in the attachment region of the bimetallic element for reducing heat transfer from the bimetallic element as well as for increasing the accuracy and the degree of reproducibility for triggering the switching device. The switching device can be implemented as a circuit breaker.

15 Claims, 3 Drawing Sheets

SWITCHING DEVICE

CROSS-REFERENCES TO RELATED APPLICATIONS

This application claims the benefit of prior filed U.S. Provisional Application No. 61/033,913, filed Mar. 5, 2008, pursuant to 35 U.S.C. 119(e).

This application further claims the priority of Austrian Patent Application, Serial No. A 357/2008, filed Mar. 5, 2008, pursuant to 35 U.S.C. 119(a)-(d), The contents of U.S. provisional Application No. 61/033,913 and Austrian Patent Application, Serial No. A 357/2008 are incorporated herein by reference in its entirety as if fully set forth herein.

BACKGROUND OF THE INVENTION

The present invention relates, in general, to a switching device.

The following discussion of related art is provided to assist the reader in understanding the advantages of the invention, and is not to be construed as an admission that this related art is prior art to this invention.

Switching devices of a type involved here disconnect a line network from the power grid in the event of excess currents in the line network lasting for a presettable time, in order to prevent further supply of electric current. This prevents damage, for example a cable fire that could occur due to increased heat-up of the conductor from the excess current flow. Such switching devices therefore have a so-called overcurrent trigger device which may include a bimetallic element that is heated by the current flowing in the line network, causing the bimetallic element to bend. At a presettable degree of bending of the bimetallic element which is proportional to a presettable heating of the line network, the bimetallic element triggers a mechanical trigger device which disconnects the switching contacts of the switching device and prevents further current flow.

Conventional switching devices are very inaccurate in triggering the switching device so that the reproducibility for triggering the switching device is very poor, in particular when the overcurrent is small. The switching device is often triggered too late—in particular for a small overcurrent where the switching device should be triggered after a longer time—which may cause problems. This exposes people and systems to risks.

It would therefore be desirable and advantageous to provide an improved switching device to obviate prior art shortcomings and to enhance accuracy, degree of reproducibility for triggering the switching device and adjustment of the overcurrent trigger device.

SUMMARY OF THE INVENTION

According to one aspect of the invention, a switching device, for example a circuit breaker, includes an input terminal and an output terminal connected to electrical conductors, first and second switching contacts which, when closed, close a current path between the input terminal and the output terminal, an overcurrent trigger device comprising a bimetallic element heated by an electric current flow, with the overcurrent trigger device operable to disconnect the first switching contact and the second switching contact, and a thermal insulator arranged in a region of attachment of the bimetallic element for reducing heat transfer from the bimetallic element.

In this way, heat transfer and/or cooling of the bimetallic element can be reduced by the way it is attached. When heat is transferred and/or the bimetallic element is cooled via its attachment, the degree of bending of the bimetallic element depends not only on the magnitude of the current in the current path through the switching device, but also on additional quantities not necessarily related to the magnitude of the current. As a result, the triggering process of conventional switching devices can be imprecise and not very reproducible. The design according to the invention improves the accuracy and the degree of reproducibility for triggering the switching device with the bimetallic element. Adjustment of the bimetallic element and/or of the overcurrent trigger device can also be improved.

According to another advantageous feature of the present invention, the bimetallic element may be attached to a first conductor of the current path. Advantageously, the first conductor is connected to the input terminal and/or the output terminal. The thermal insulator may be implemented as a metallic electric conductor and may be formed in the attachment region of the thermal insulator for increasing electrical resistance. The thermal insulator may include a plate arranged between the first conductor and the bimetallic element with a thermal conductivity of less than 350 W/(m*K), or less than 200 W/(m*K), or even less than 85 W/(m*K). The plate may be made of aluminum, brass, zinc, steel, stainless steel, nickel, iron, platinum, tin, tantalum, lead or titanium, or a mixture thereof.

The bimetallic element may connected to the first electrical conductor with a rivet having a thermal conductivity of less than 350 W/(m*K), or less than 200 W/(m*K), or even less than 150 W/(m*K). The rivet may be made of aluminum, brass, zinc, steel, stainless steel, nickel, iron, platinum, tin, tantalum, lead or titanium, or a mixture thereof.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 3 shows an uncut axonometric view of the embodiment of FIG. 2 in;

DETAILED DESCRIPTION OF PREFERRED EMBODIMENTS

Figure 1:
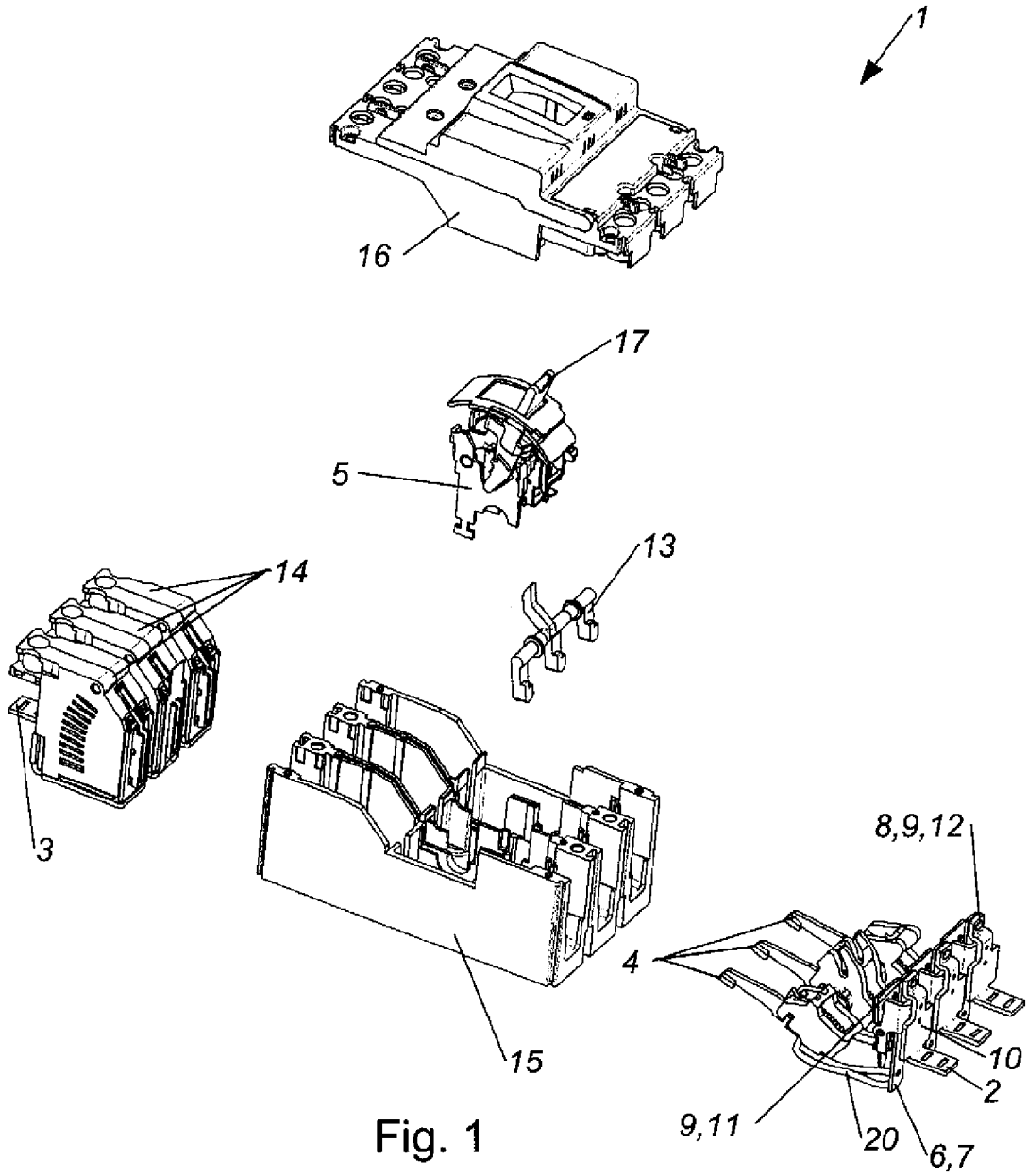
FIG. 1 shows an axonometric exploded view of a preferred embodiment of a switching device according to the invention.
Figure 2:
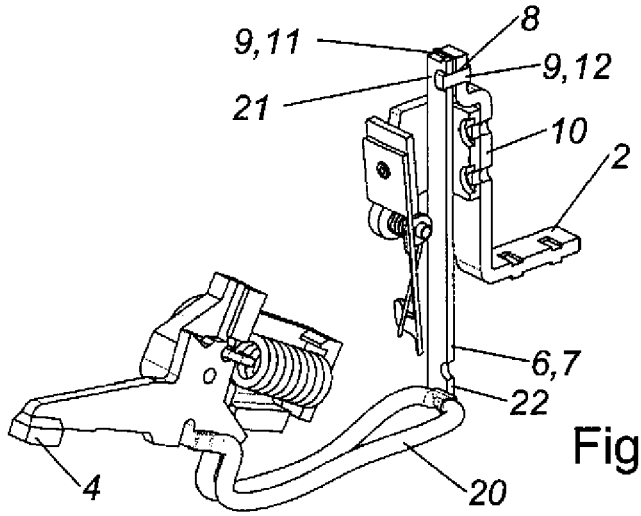
FIG. 2 shows a partially cut axonometric view of a preferred embodiment of an arrangement of a bimetallic element and a first switching contact.
Figure 3:
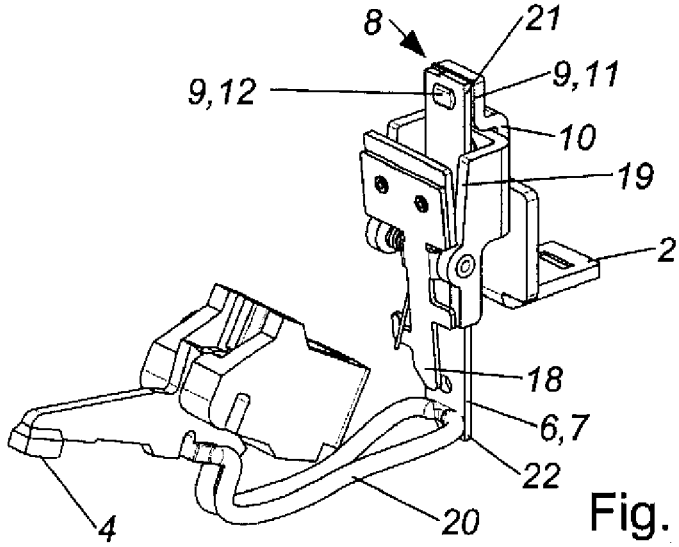
Figure 4:
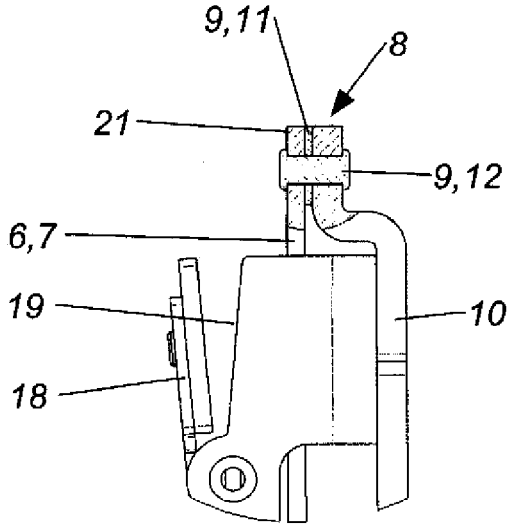
FIG. 4 shows a partially broken-out elevation of a detail of the arrangement of FIG. 2.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a switching device, generally designated by reference numeral 1 and configured in particular in the form of a circuit breaker. The switching device 1 has at least one input terminal 2 and at least one output terminal 3 for connecting electrical conductors, and a first switching contact 4 and a second switching contact. When the switching contacts 4 assume a closed position, they close a current path between the input terminal 2 and the output terminal 3. An overcurrent trigger device 6 is provided for disconnecting the first switching contact 4 and the second switching contact. The overcurrent trigger device 6 includes at least one bimetallic element 7 which is heated by the electric current flow, wherein in the region of an attachment 8 of the bimetallic element 7 at least one thermal insulator 9 is arranged for reducing heat transfer from the bimetallic element 7.

Heat transfer and/or cooling of the bimetallic element 7 via its attachment 8 can thereby be reduced. Heat transfer and/or cooling of the bimetallic element 7 via its attachment 8 has the consequence that bending of the bimetallic element 7 depends not only on the magnitude of the current in the current path through the switching device 1, but also on other quantities which are not necessarily related to the magnitude of the current, with the result that triggering of conventional switching devices 1 is imprecise and not very reproducible. With the features of the invention, the accuracy and the degree of reproducibility of triggering the switching device by the bimetallic element 7 can be improved. This can also improve adjustment of the bimetallic element 7 and/or of the overcurrent trigger device 7.

FIG. 1 shows an axonometric exploded view of a number of assemblies of a preferred embodiment of a switching device 1 according to the invention. The switching device 1 has three switching paths or current paths. Of course, any predeterminable number of switching paths or switchable current paths can be implemented. Preferably, switching devices 1 according to the invention with one, two, three or four current paths are contemplated. The number of input terminals 2 and/or output terminals 3 is then identical to the number of current paths. FIGS. 1 to 4 illustrate only those parts of the input terminals 2 and the output terminals 3 that are fixed with respect to the housing. Each of the respective input terminals 2 and output terminals 3 typically includes, in addition to the illustrated parts, at least one terminal screw and preferably also a clamping cage moved by the terminal screw.

The switching device 1 includes a housing made of an insulating material, which in the preferred embodiment includes a lower housing shell 15 and an upper housing shell 16. The at least one first switching contact 4 rests in a closed position on the at least one second switching contact, which in the illustrated embodiment is arranged inside the component of the arc quenching chamber 14, but is obscured from view.

According to the invention, the bimetallic element 7 is attached at a predeterminable location inside the switching device 1. Preferably, as illustrated, the bimetallic element 7 is attached to a first conductor 10 of the current path, which is preferably associated with the input terminal 2 and/or the output terminal 3. Current thus flows directly through the bimetallic element 7 which is therefore part of the current path, and is therefore directly heated by the current. Alternatively, the bimetallic element can be—completely or additionally—indirectly heated, for example by arranging a current-carrying conductor on the bimetallic element 7. Attachment of the bimetallic element 7 on the first conductor advantageously helps the preferred embodiment, because this results in a particularly simple construction which can be manufactured cost-effectively.

Figure 5:
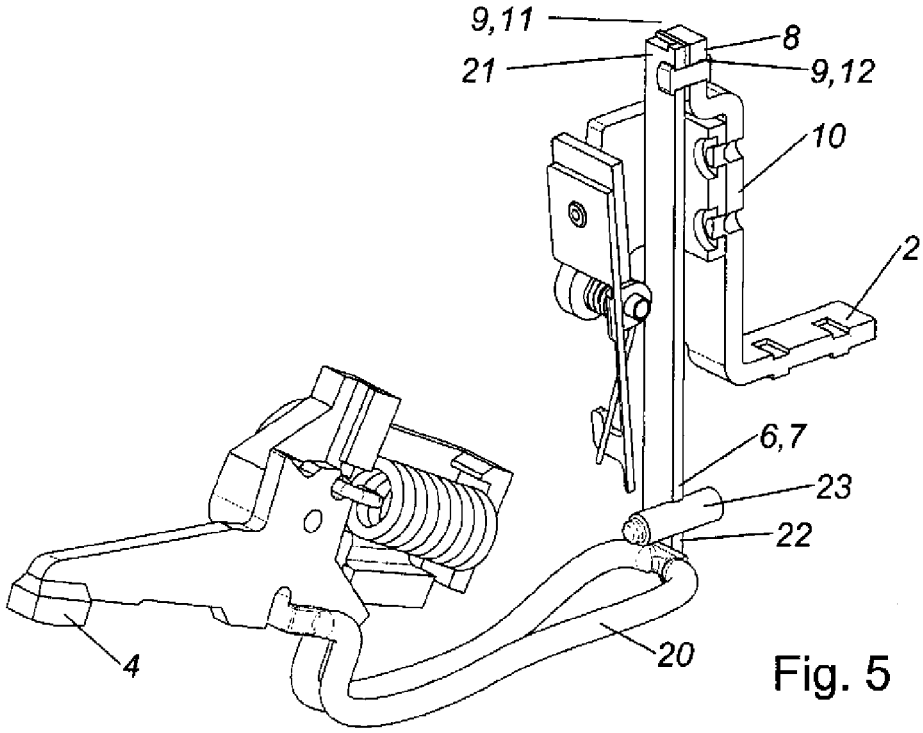
FIG. 5 shows the arrangement of FIG. 2 with an additional component.
Figure 6:
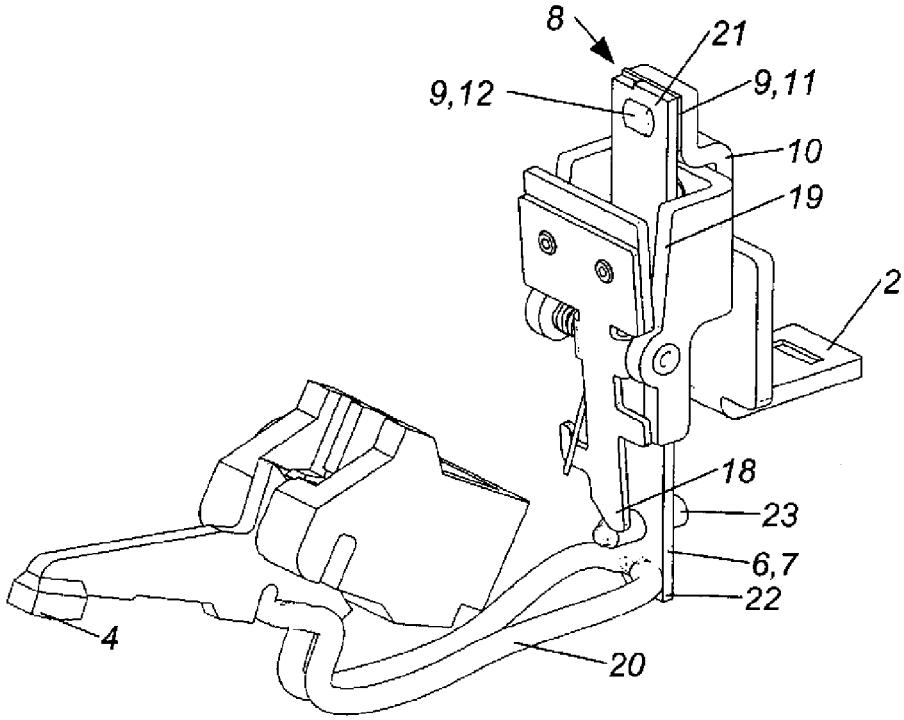
FIG. 6 shows the arrangement of FIG. 3 with an additional component.

With increasing heat-up from the current flow, the bimetallic element 7 is progressively bent. At a predeterminable degree of bending of the bimetallic element 7, which is proportional to a predeterminable heat-up of the line network, the bimetallic element 7 triggers the overcurrent trigger device 6, which disconnects the switching contacts 4 of the switching device 1 either directly or by way of an additional mechanical trigger device which cooperates with and/or is controlled by the overcurrent trigger device 6, thereby preventing additional current flow. The switching device 1 has for this purpose a hinged lever 18. The hinged lever 18 can be directly controlled by the bimetallic element 7. Preferably, the bimetallic element 7 has—as illustrated in FIGS. 5 and 6—an adjustment screw 23 which actuates the trigger shaft 13 at a predeterminable deformation of the bimetallic element 7. The deformation of the bimetallic element 7 required for actuating the trigger shaft 13 can also be preset and/or adjusted with the adjustment screw 23. In addition, the trigger shaft 13 is preferably also associated with a short-current trigger 19 arranged in the switching device 1, wherein the short-circuit trigger 19 is configured to operate the trigger shaft 13 with the hinged lever 18. When the deformation of the bimetallic element 7 reaches a preset value, the bimetallic element 7 moves the trigger shaft 13 with the adjustment screw 23 which operates the switch latch 5. The switch latch 5 is provided for manually opening and closing the switching contacts 4 with the operating lever 17, and for disconnecting the switching contacts 4 when the overcurrent trigger device 6 and/or the short-circuit trigger 19 are triggered.

FIGS. 2 to 6 show different views of a preferred embodiment of an arrangement of bimetallic element 7 and a first switching contact 4, wherein at least one thermal insulator 9 is arranged in the region of attachment 8 of the bimetallic element 7 to reduce heat transfer from the bimetallic element 7. A first end 21 of the bimetallic element 7 is attached to the first conductor 10. Although in the illustrated attachment a connecting rivet 12 is used for attachment, the bimetallic element 7 can also be attached with screws, clips, by welding or soldering. A flexible conductor 20, which connects the bimetallic element 7 with the first switching contact 4, is arranged on the second end 22 of the bimetallic element 7 opposite the first end 21.

Any type of thermal insulator 9 can be used to prevent heat transfer from the bimetallic element 7. For example, insulators including glass and/or ceramic can be employed in conjunction with the indirectly heated bimetallic element 7. In the preferred illustrated embodiment, in which a current flows via a direct current path through the bimetallic element 7, the thermal insulator is preferably formed as a metallic electric conductor, wherein the thermal insulator 9 is preferably formed in the attachment 8 region to increase the electrical resistance. This not only reduces heat transfer and improves cooling of the bimetallic element 7 by the first conductor 10 and/or the input and/or output terminal 2, 3, but the bimetallic element 7 is heats up even more due to the presence of the thermal insulator 9. Because this additional heat-up takes place at the first end 21 and is hence far removed from the second end 22, the mechanical effect is particularly strong because the additional heat-up increases deformation and increases the torque that can be produced by the bimetallic element 7. This not only increases the mechanical effectiveness of the bimetallic element 7, but also the triggering accuracy by further reducing the impact from the physical environment on the heat-up of the bimetallic element 7.

As illustrated in FIGS. 1 to 4, the thermal insulator 9 preferably includes a plate 11 arranged between the first conductor 10 and the bimetallic element 7. Such plate 11 or metal sheet provides a high mechanical stability as well as a high degree of thermal isolation. Preferably, the plate has a thermal conductivity of less than 350 W/(m*K), in particular less than 200 W/(m*K), preferably less than 85 W/(m*K). "W" is here the power in Watt, "m" the longitudinal dimension in meter, "K" the absolute temperature in Kelvin, and "*" the multiplication operator. The heat transfer via the plate is then less than the heat transfer through direct contact with the first conductor 10 which is typically formed of copper. The plate 11 can include any material with a smaller thermal conductivity coefficient than copper, wherein the plate 11 can be a metallic electrical conductor in a technical sense with a specific electrical resistance of less than 0.5 $\Omega*mm^2/m$, preferably less than 0.2 $\Omega*mm^2/m$. However, the specific electrical resistance should be greater than the specific electrical resistance of copper (approximately 0.01724 $\Omega*mm^2/m$). The plate 11 may include at least one material selected from the group consisting of aluminum, brass, zinc, steel, preferably stainless steel, nickel, iron, platinum, tin, tantalum, lead and/or titanium. Currently preferred is an embodiment, in which the plate 11 is made of a material which includes steel, in particular stainless steel, whereby a particularly advantageous equilibrium of electrical conductivity, resistance and thermal insulation can be obtained. Steel also has good mechanical machinability and low costs.

As mentioned above, any type of attachment of the bimetallic element 7 with the first conductor 10 can be contemplated. In a particularly preferred embodiment illustrated in FIGS. 1 to 4, the bimetallic element is connected to the first conductor 10 with at least one connecting rivet 12. To further increase the effectiveness of the thermal insulator 9, the thermal insulator 9 preferably includes the connecting rivet 12. Alternatively, the thermal insulator 9 may only include the at least one connecting rivet 12, while the plates 11 arranged between the bimetallic element 7 and the first conductor 10 are omitted.

In the implementation with the connecting rivet 12, the connecting rivet 12 has a thermal conductivity of less than 350 W/(m*K), in particular less than 250 W/(m*K), preferably less than 150 W/(m*K). "W" is here the power in Watt, "m" the longitudinal dimension in meter, "K" the absolute temperature in Kelvin, and "*" the multiplication operator. The heat transfer through a connecting rivet 12 formed in this manner is then less than the heat transfer through a corresponding connecting rivet 12 made of copper. For example, the connecting rivet 12 can include any material having a smaller thermal conductivity coefficient than copper. The connecting rivet 12 may be also a metallic electrical conductor in a technical sense with a specific resistance of less than 0.5 $\Omega*mm^2/m$. In addition to technical parameters relating to the electrical and thermal conductivity, the potential for ductile mechanical deformation is also important for the material used for a connecting rivet 12. The connecting rivet 12 may include at least one material selected from the group consisting of aluminum, brass, zinc, steel, preferably stainless steel, nickel, iron, platinum, tin, tantalum, lead and/or titanium. Currently preferred is an embodiment, in which the connecting rivet 12 includes brass, whereby any type of brass alloy which includes copper and zinc can be used.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A switching device, comprising:

an input terminal and an output terminal for connection to electrical conductors;

first and second switching contacts which, when closed, close a current path between the input terminal and the output terminal;

an overcurrent trigger device comprising a bimetallic element heated by an electric current flow, said bimetallic element is attached to a first conductor of the current path, said overcurrent trigger device operable to disconnect the first switching contact and the second switching contact; and a thermal insulator arranged in a region of attachment of the bimetallic element for reducing heat transfer from the bimetallic element, wherein the bimetallic element is connected with the first electrical conductor with a connecting rivet constructed as a thermal insulator, and wherein the thermal insulator includes the connecting rivet.

2. The switching device of claim 1, wherein the thermal insulator is implemented as a metallic electric conductor.

3. The switching device of claim 1, wherein the thermal insulator is formed in the region of attachment for increasing electrical resistance.

4. The switching device of claim 1, wherein the thermal insulator comprises a plate arranged between the first conductor and the bimetallic element.

5. The switching device of claim 4, wherein the plate has a thermal conductivity of less than 350 W/(m*K).

6. The switching device of claim 4, wherein the plate has a thermal conductivity of less than 200 W/(m*K).

7. The switching device of claim 4, wherein the plate has a thermal conductivity of less than 85 W/(m*K).

8. The switching device of claim 4, wherein the plate comprises at least one material selected from the group consisting of aluminum, brass, zinc, steel, stainless steel, nickel, iron, platinum, tin, tantalum, lead and titanium.

9. The switching device of claim 1, wherein the connecting rivet has a thermal conductivity of less than 350 W/(m*K).

10. The switching device of claim 1, wherein the connecting rivet has a thermal conductivity of less than 200 W/(m*K).

11. The switching device of claim 1, wherein the connecting rivet has a thermal conductivity of less than 150 W/(m*K).

12. The switching device of claim 1, wherein the connecting rivet comprises at least one material selected from the group consisting of aluminum, brass, zinc, steel, stainless steel, nickel, iron, platinum, tin, tantalum, lead and titanium.

13. The switching device of claim 1, wherein the switching device is implemented as a circuit breaker.

14. The switching device of claim 1, wherein the first conductor is electrically connected to the input terminal or the output terminal or both.

15. The switching device of claim 1, wherein the thermal insulator is embodied as the connecting rivet.

* * * * *